United States Patent [19]

Quinnell

[11] Patent Number: 5,003,732

[45] Date of Patent: Apr. 2, 1991

[54] ROOF VERGE SYSTEM

[75] Inventor: Geoffrey C. Quinnell, Pembury, England

[73] Assignee: Marley Tile A.G., Switzerland

[21] Appl. No.: 307,965

[22] Filed: Feb. 9, 1989

[30] Foreign Application Priority Data

Feb. 9, 1988 [GB] United Kingdom ..... 8802875

[51] Int. Cl.[5] ..... E04B 7/00

[52] U.S. Cl. ..... 52/94; 52/95; 52/738; 52/58

[58] Field of Search ..... 52/726, 823, 94, 276, 52/58, 738, 96, 95

[56] References Cited

U.S. PATENT DOCUMENTS

| | | | |
|---|---|---|---|
| 2,358,396 | 9/1944 | Hogan | 52/94 |
| 3,388,510 | 6/1968 | Smith | 52/94 |
| 3,631,644 | 1/1972 | Mazza | 52/823 |
| 3,700,385 | 10/1972 | Sherwood | 52/823 |
| 3,791,088 | 2/1974 | Sandow | 52/726 |
| 4,257,206 | 3/1981 | Mieyal | 52/726 |
| 4,332,117 | 6/1982 | Quinnell | 52/94 |
| 4,442,641 | 4/1984 | Quinnell | 52/94 |
| 4,580,374 | 4/1986 | Quinnell | 52/95 |
| 4,643,080 | 2/1987 | Trostle | 52/726 |
| 4,685,265 | 8/1987 | Cooper | 52/276 |
| 4,843,953 | 7/1989 | Sells | 52/58 |

FOREIGN PATENT DOCUMENTS

| | | |
|---|---|---|
| 0223480 | 5/1987 | European Pat. Off. . |
| 281523 | 12/1912 | Fed. Rep. of Germany . |
| 2200424 | 4/1974 | France . |
| 1090291 | 11/1967 | United Kingdom . |
| 2164369A | 3/1986 | United Kingdom . |
| 2204617A | 11/1988 | United Kingdom . |

*Primary Examiner*—Henry E. Raduazo

*Attorney, Agent, or Firm*—Bacon & Thomas

[57] ABSTRACT

A system for covering the edges of slates or the like at the verge of a pitched roof, comprises a plurality of verge members (1, 2) joined by a union (3). Each verge member has a pair of flanges (5, 7) and a pair of channels (9, 10) defining two spaces (17, 18) for receiving the edges of the slates. The channels (9, 10) are disposed symmetrically between the flanges (5, 7) but one of the flanges has a portion (6) which results in the space (17) being narrower than the space (18), so that the verge member can be used with slates of different thicknesses. The union (3) joins together the verge members (1, 2) in such a way that the channels (9) being used are connected in a waterproof manner. The union (3) thus comprises an upstream portion (30) which underlies the channel (9) of the verge member (2) up the roof, and a downstream portion (31) which overlies the channel (9) of the verge member (1) down the roof, the portions (30, 31) being joined by a wall (32) extending between the ends of the two channels (9).

22 Claims, 4 Drawing Sheets

ROOF VERGE SYSTEM

BACKGROUND OF THE INVENTION

This specification concerns a roof verge system. In particular there is disclosed a member for weathering, or capping, the edges of slates or the like at the verge of a roof.

In the course of non-public investigations by the applicant into the capping of natural or synthetic slates, or similar roof covering members, at the verge of a roof, consideration has been given to the use of an elongate member having a vertical portion and two inwardly projecting portions which respectively overlie the top and bottom surfaces of the slates. The lower of the inwardly projecting portions preferably acts as a concealed "gutter" which sill permit any rain water which seeps below the slates to flow down the roof to where it can, for example, be discharged into a conventional gutter system. In general, such arrangements are known and reference is made to WO 81/01583 which discloses a verge system for use with interlocking roof tiles. In this system, the lower portion is flat and serves to conduct water down the roof even though the portion is not, strictly speaking, formed as a channel.

In the course of the investigations referred to above, consideration has been given to the production of a single member which would be suitable for slates of differing thickness. Consideration has also been given to the design of a union by means of which two members could be joined together longitudinally in such a way that there would be a continuous concealed gutter extending down the roof, but avoiding the use of solvent welding or other separate means of sealing the joints between the various components.

SUMMARY OF THE INVENTION

The invention resulting from the above-mentioned non-public investigations includes both a unique roof verge member and a unique union. As regards the union, a simple construction has been devised which will permit the joining of two downwardly inclined lengths of water conducting members. Viewed generally from one aspect, this union for two longitudinally aligned, downwardly inclined, water conducting members comprises a first portion underlying the lower surface of the upper member, the first portion extending from a point longitudinally spaced from the lower free end of the upper member to such lower free end; a second portion overlying the upper surface of the lower member, the second portion extending from the upper free end of the lower member to a point longitudinally spaced from such upper free end, and a wall which interconnects the first and second channel wall portions and passes between the respective free ends of the two members.

An important point about such as arrangement is that it is for use in joining two inclined members. In use, water flowing down the upper member will encounter the wall interconnecting the channel wall portions, thus forming a dam. It will then flow over the dam portion and down onto the lower member so as to continue flowing downwardly. In the absence of solvent welding or other sealing means, there will also be a tendency for water to seep down between the free end of the upper member and the dam portion. This however cannot escape immediately since it encounters the first portion of the union which underlies the upper member. It will then tend to flow back between this first portion of the union and the upper member. However, because the members are inclined, the direction of this flow is uphill. Providing the first union portion is sufficiently long, having regard to e.g. the inclination angle, the anticipated flow and the height of the dam portion, it can be so arranged that no water reaches the end of the first portion and escapes from the union. Similarly, any water which might tend to seep back under the second portion of the union, overlying the lower member, is flowing uphill and similar considerations apply.

Whilst this union was designed with particular regard to the verge system referred to earlier, it will be of use in other contexts. It is considered inventive in its own right and protection is sought in broad terms for the union and its use with inclined water conducting members.

As regards the verge member itself, consideration has been given to a member which viewed broadly from one aspect comprises a planar portion to extend down the verge of the roof so as to conceal the edges of the slates or the like, inwardly directed flanges along both edges of the planar portion, and a pair of water conducting members on the inner surface of the planar portion, each respectively facing one of the flanges, with the spacing between one flange and its associated facing water conducting member being greater than the spacing between the other flange and its associated facing water conducting member. The member as a whole will generally be of regular cross section rather than tapering as in e.g. the system of WO 81/01583 referred to above. Depending on which way up the member is used, there will be a larger or smaller spacing between the flange and water conducting member which will be used in capping the slates or the like. Thus, two different thickness of slate can be handled. Such a verge member as outlined broadly above, is considered inventive in its own right and protection is sought in broad terms for the verge member.

By combining the two features of the union and the member design, a particularly effective system can be obtained. However, a problem has been identified in designing the combined system. In use, in joining the verge members, to give the desired effect in terms of function and appearance, the union should—apart from the portions discussed broadly above—preferably have portions which will overlie the two flanges and the planar portion of each verge member. Thus the two verge members as a whole will be fitted into the union, as well as the water conducting members being joined together in a watertight manner. However, with the verge member as described above, the two water conducting members are of course disposed asymmetrically between the flanges. Similarly, the union will have an asymmetric configuration. This means that two union shapes will be required—one left handed for use along one side of the roof and one right handed for use along the other side of the roof. The problem does not arise with the verge members themselves, since the can simply be reversed for use on one side of the roof or the other. However, the union is not reversible since the watertight joint can only work in one direction.

To deal with this problem therefore a further improved verge member has been devised which will enable a symmetrical union to be used, so that only one union shape is required regardless of which side of the roof is concerned. Viewed broadly from one aspect, this verge member comprises a planar outer portion to extend down the verge of the roof so as to conceal the edges of the slates or the like, inwardly directed flanges along both edge of the planar portion, and a pair of water conducting members on the inner surface of the planar portion, each respectively facing one of the flanges, the water conducting members being disposed symmetrically between the flanges but one of the flanges having a portion along its free edge which extends towards its associated water conducting member so as to reduce the size of the gap through which the edge of a slate or the like will pass in use. By this means, different sized gaps are provided but in terms of the portions which cooperate with the union, the arrangement is symmetrical. Such a verge member is considered inventive and protection is sought in broad terms for the member in its own right.

It will be appreciated that for the system to operate satisfactorily, various parts will need to be of the same size and shape, and designed to cooperate with other parts, and the dimensions of the water conducting members, dimensions of the union portions and so forth will be chosen to provide adequate removal of water in a reliable manner. These matters are within the competence of one skilled in the art.

Furthermore, when the verge members are to be used with the particular union discussed above, there should be a gap between the two water conducting members so as to permit the appropriate portions of the union to pass between them in order to underlie the appropriate water conducting member.

As regards the construction of the union for use in the combined system using the preferred verge members, it will be gathered from the above that this will include a pair of oppositely facing, symmetrically disposed, arrangements, each having the said first, second and dam portions. These arrangements will generally be provided on the inner surface of a planar portion which will overlie the planar portions of the verge members being joined. Furthermore, there will generally be inwardly directed flanges on the planar portion, to overlie the flanges on the verge member.

The water conducting members of the verge members, or any other member for use with the union, could be flat as in the system of e.g. WO 81/01583 discussed above. However, preferably they are in the form of channel members to provide more effective conduction of water. In such a case, the first and second portions of the union, which will respectively underlie and overlie the channel members being joined, should also underlie and overlie sides of the channel members.

In a preferred construction of verge member each channel member has portions downwardly directed and upwardly directed with respect to the planar portion. The union will have a corresponding configuration.

In general the verge members and unions will be of a plastics material and formed by extrusion, injection moulding or the like. However, other materials and forming methods are possible.

It will be appreciated that protection is sought not only for the verge members and unions independently, but for the combinations of the components, their use of a roof, and roof with a verge system using the components.

Consideration has also been given to means for securing the verge members, of either design discussed above, to a roof. This can present problems, particularly in terms of thermal contraction and expansion. Where dark colours (which absorb heat more readily) are used, or long continuous lengths of member are used, these thermal effects can be significant.

Accordingly, a preferred arrangement involves the use of clips which have portions to be secured to roof battens or the like, and portions which restrain the verge member against lateral movement but permit sliding movement relative to the clip. In systems where the verge members have channels members, the clips may have portions which clip over the inner walls of the channel members. The use of the second type of verge member, with the symmetrically disposed channel members, enables a single type of clip to be used in the same way on both sides of the roof. One or more suitable clips, such as the topmost clip along the verge, may be secured by a screw or the like to the verge member to prevent sliding movement so that it serves as an anchor clip. In a preferred arrangement the clip can also be used to block off the ends of the verge members, at the bottom of the roof.

As a whole, the preferred system has a number of advantages, including the need for three components only (the verge member, union and clip), the ability to cope with slates of different thicknesses, a neat external appearance, and effective channeling of water down the roof in a concealed manner. Individually all of the components may have uses in other contexts and the system as a whole may be used not only with slates and imitation slates, but with plain tiles, interlocking tiles, profiled tiles with suitably flat edge regions (provided e.g. by an interlocking region) wood shingles and so forth.

BRIEF DESCRIPTION OF THE DRAWINGS

A verge system for a roof, embodying several of the features discussed above, will now be described by way of example only of some of the broad aspects outlined, with reference to the accompanying drawings in which.

DESCRIPTION OF THE PREFERRED EMBODIMENTS

Figure 1:
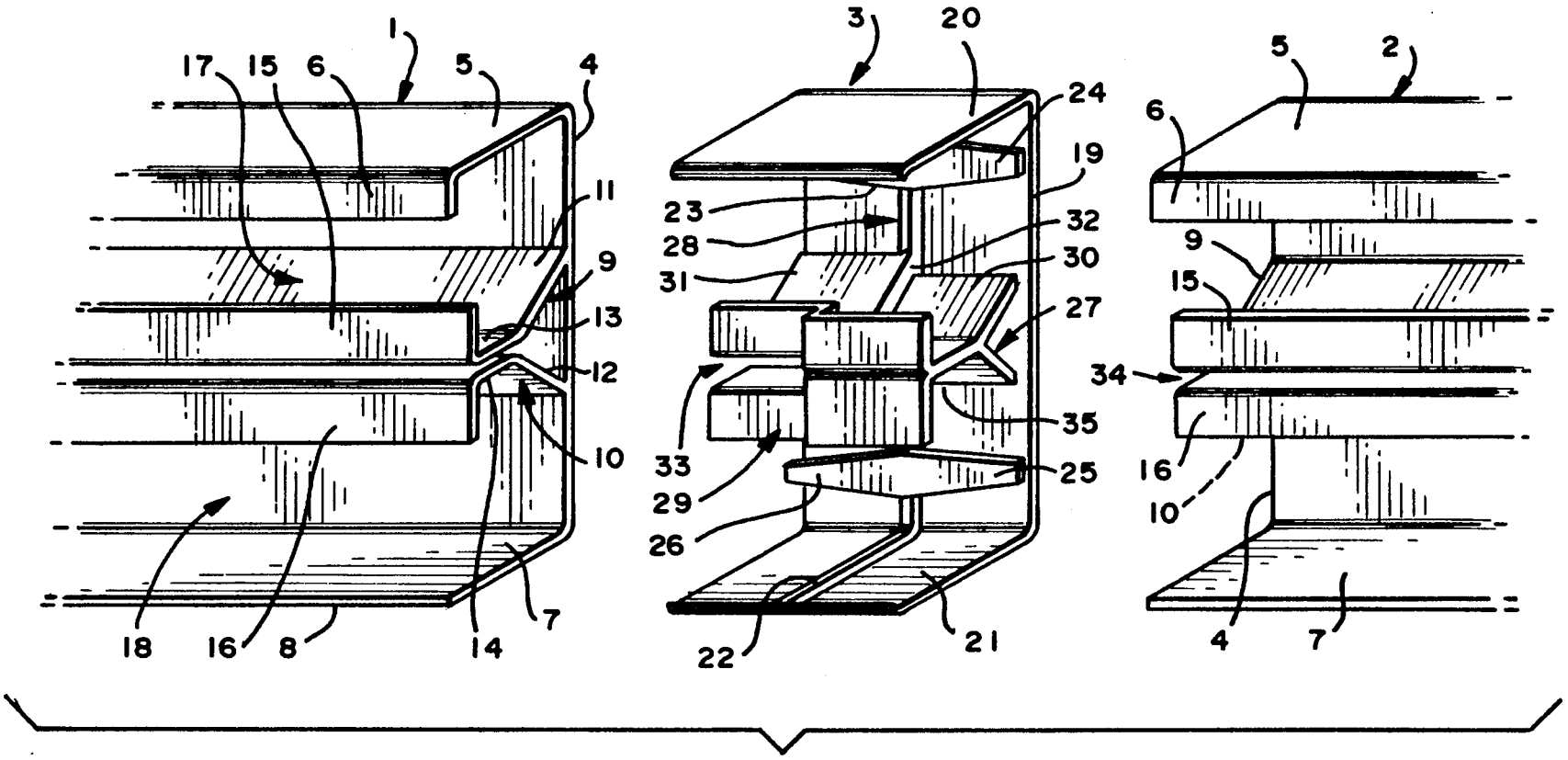
FIG. 1 is a perspective view of two verge members and a union, in an unassembled condition.

With reference now to FIG. 1, there are shown two identical extruded plastics elongate verge members 1 and 2 to be joined by a union 3. The verge member comprises a vertically extending planar outer portion 4 having at its upper edge an inwardly perpendicularly directed flange 5 terminating at its free edge in a downwardly perpendicularly directed terminal portion 6. Along its lower edge the planar portion 4 has an inwardly perpendicularly directed flange 7 terminating in a free edge 8.

Disposed centrally of the planar outer portion 4, and arranged symmetrically, are two inwardly directed water conducting members or channels 9 and 10 which run parallel to the flanges 5 and 7. The water conducting channels 9 and 10 are of identical cross section, having inwardly directed inclined first side wall portions 11 and 12 respectively, flat bottom wall portions 13 and 14 respectively, and vertically directed second side wall portions 15 and 16 respectively. The symmetry is such that the space between the free edge of side wall portion 15 and the main part of flange 5 is equal to the space between the free edge of side wall portion 16 and the flange 7.

Figure 6:
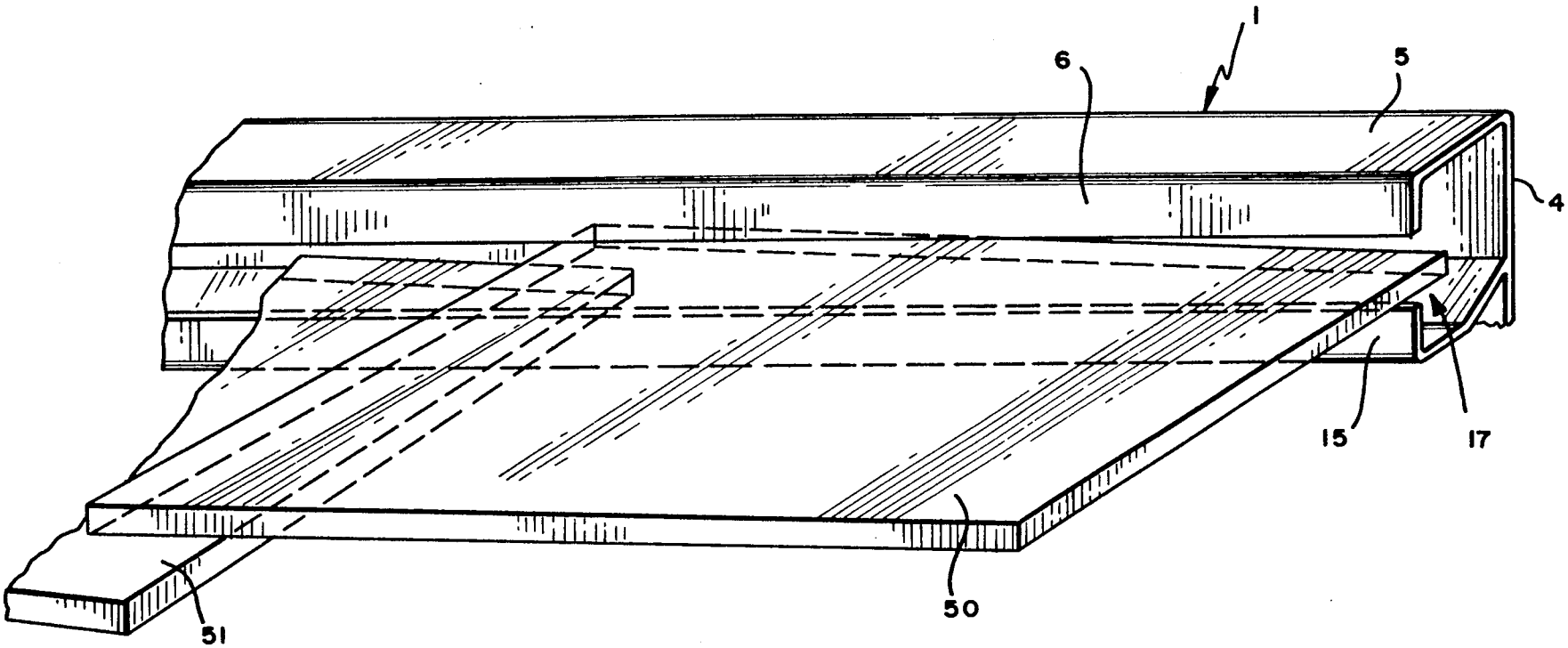
FIG. 6 is a view showing a part of a verge member and two roof covering members.

Between the free edge of the upwardly directed side wall portion 15 of the channel 9 and the free edge of downwardly directed terminal portion 6 of flange 5, is formed a first gap 17 to receive the edge of at least one slate of a particular thickness, which will be shielded by the verge member 1 as shown in FIG. 6. In FIG. 6, gap 17 of verge member 1 is arranged to receive roof covering members 50 and 51, which themselves may be arranged in a variety of known roof covering configurations. Gap 17 is of reduced size in view of the additional, downwardly directed terminal portion 6. The channel 9 will carry away any water which gets beneath the slate. The verge member 1 is elongate and will receive a number of slates. Slight resilience in the material of the verge member 1 will allow for the slate thickness to vary somewhat it being preferable that the free edges of side wall portions 15 and 16 engage the surfaces of the slates.

However, by turning the verge member the other way up, a slate of substantially greater thickness can be received in an alternative gap 18 between the free edge 8 of flange 7, and the free edge of side wall portion 16 of channel 10 with these free edges again preferably engaging the surfaces of the slate. Thus, the single verge member 1 can be used for widely varying slate thicknesses simply by being turned upside down.

The union 3 is designed to join together the verge members 1 and 2 and to ensure that there is a watertight join between the operative channels, i.e. channels 9 or 10, regardless of which way up the verge members are used.

The union 3 has a vertically extending planar outer portion 19 having first and second perpendicularly inwardly directed flanges 20 and 21 along its edges. Thus, the union can overlie outer portion 4 and flanges 5 and 7 of the verge members 1 and 2 so as to weather the joint between the members. A rib 22 extends around the inside of the union, on flange 20, outer portion 19 and flange 21, to serve as a locating stop when the verge members and union are being joined together. The width of the union either side of rib 22 is sufficient to ensure that the joint remains adequately weathered even if the verge members 1 and 2 move apart longitudinally as a result of thermal expansion.

On the rib 22 are provided four optional locating flanges 23,24,25 and 26 which overlie the inner wall of the vertical outer portion 4 of the verge member 1 and 2 to assist in location. These may be omitted and in cases where extreme temperature conditions are encountered it may be better to omit them. If excessive thermal expansion occurs, the locating flanges might in some circumstances hinder proper retraction of the verge members fully into the union once cooling takes place.

Disposed centrally of outer portion 19 of the union is a junction indicated generally at 27 to join together the channels 9 and 10 of the respective verge members 1 and 2. The union can be used either way up but will only work in one particular direction of water flow along the channels. With the system described this presents no problem since although there is asymmetry of the verge members in terms of the slate receiving gaps 17 and 18, the channels 9 and 10 are disposed symmetrically. As a result, the union is used one way up for flow in one direction and the other way up for flow in the other direction, but in either configuration can cope with the verge members being either way up. Whether channels 9 or channels 10 of the verge members 1 and 2 are being joined, the union can be fitted correctly to provide a watertight joint.

The junction 27 consists of two mirror image portions 28 and 29. In view of the symmetry, only portion 28 will be described in detail. This portion consists of an upstream part 30 configured to receive a channel (channel 9 in the configuration shown in FIG. 1). Upstream channel-shaped part 30 has a cross section matching that of the channel and is adapted to extend around the outside of the channel wall portions (11,13 and 15 for channel 9). Portion 28 has also a downstream part 31 configured to fit inside the channel, having a cross section matching that of the channel and being adapted to extend around the inside of the channel wall portions (11,13 and 15 for channel 9). The upstream channel-shaped part 30 and downstream channel-shaped part 31 are joined by a wall 32 which extends completely around the periphery of parts 30 and 31 and forms a dam interconnecting the respective channel wall portions (11,13 and 15 for channel 9).

As can be seen, the respective downstream parts of junction portion 28 and its mirror image junction portion 29 are spaced apart at 33. Thus, when verge member 1 is pushed into the union 3, the space 33 will receive the bottom wall portions 13 and 14 of the channels 9 and 10, and of course channel 10 of member 1 will be received in the junction portion 29. Similarly, the channels 9 and 10 are themselves spaced apart by a longitudinally extending space 34 so as to receive the common wall of upstream channel-shaped part 30 of the junction and its mirror image upstream channel-shaped part 35, with channel 10 of member 2 being received in this part 35. Thus, the verge members 1 and 2, and union 3, are securely joined together.

Figure 2:
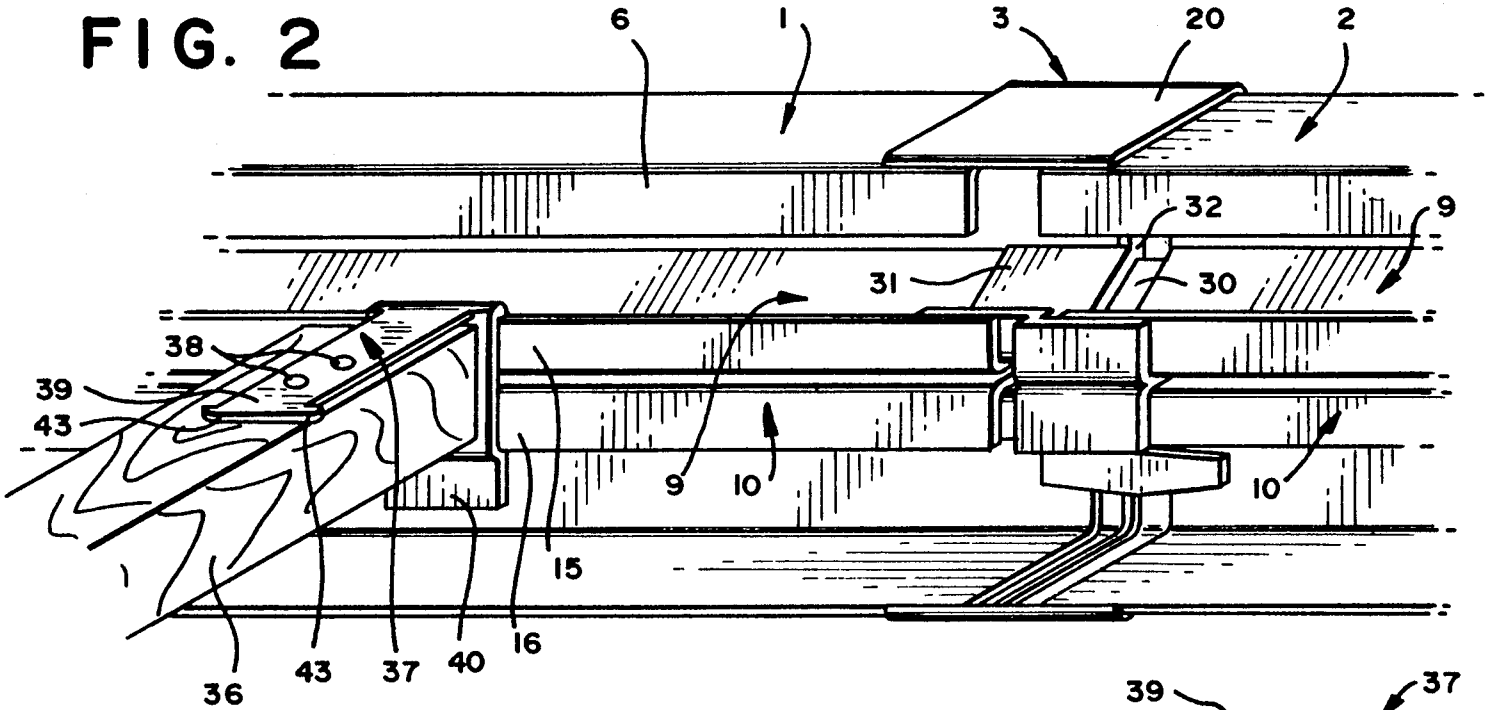
FIG. 2 is a perspective view of the three components in the assembled condition, and showing also a retaining clip secured to a roof batten.

FIG. 2 shows the verge members 1 and 2 and the union 3 joined together. The members 1 and 2 extend down the side of a roof, with the top, i.e. ridge, of the roof being to the right of the figure as shown. In this configuration, the operative channel is 9 and any water seeping below slates (not shown) will flow down this channel from the right of the figure to the left.

Any water flowing down channel 9 of verge member 2 towards the union 3 encounters the wall 32 between parts 30 and 31. At a certain flow, the water will pass over the dam formed by wall 32 and onto part 31, from where it will flow down onto channel 9 of verge member 1. Because the arrangement is inclined, and the extent of part 30 is sufficient, the water will always flow over to part 31 before it can seep back up underneath channel 9 of verge member 2, between it and part 30, far enough to reach the end of part 30 and escape from the joint. The inclination, and extent of part 31 also tends to reduce any tendency for water to seep back up under part 31 far enough to escape from the joint. It may be desirable to arrange tolerances between the channels 9 and respective parts 30 and 31 so as to reduce a tendency for capillary action which could draw water up the gaps between the components.

Although the union 3 is designed for use without any extra seals or the use of e.g. solvent welding, it would be possible to use such features to seal the channels to the parts 30 and 31. In that case, some advantages of the union would be its general structural stability and its capability of dealing with any sealing failures with the seals solvent welding or the like. Furthermore if there are level, or shallowly inclined, roof portions such sealing means may be necessary if the same unions are to be used.

Figure 3:
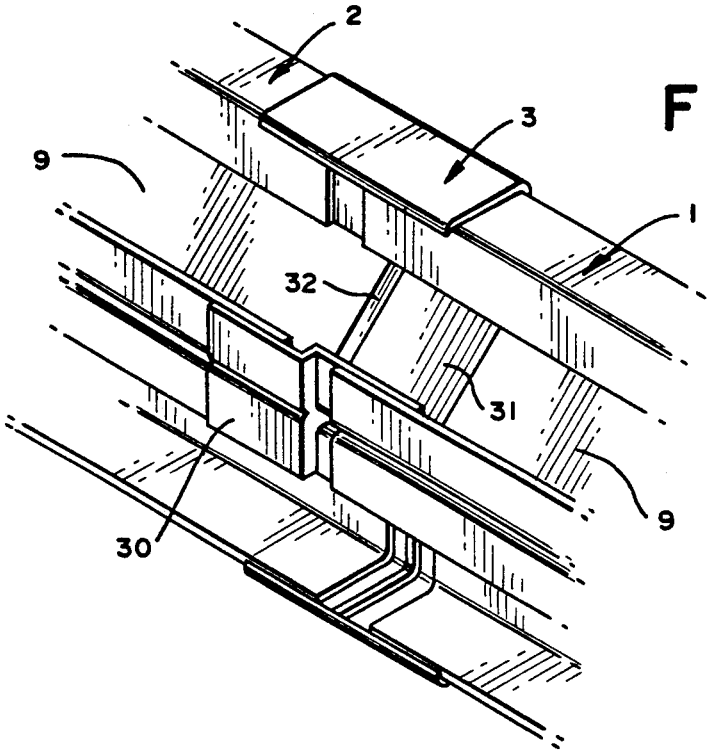
FIG. 3 is a perspective view of the components in the assembled condition, configured to go down in the opposite direction from the configuration of FIG. 2.

FIG. 3 shows the appearance of two verge members 1 and 2 joined by the union 3, extending down the roof on the other side of the roof ridge, i.e. with the top of the roof to the left in the figure as drawn. As will be appreciated, the union 3 has been turned upside down as compared to FIGS. 1 and 2. Because of the features of symmetry referred to earlier, this is possible whilst ensuring a correct fit.

By turning upside down the entire arrangements of FIGS. 2 and 3, i.e. both union and verge members, the channels 10 will be operative and thicker slates can be received in the gaps 18. It is still important to ensure that the arrangements are used such that the overlying part (i.e. 31 in FIGS. 2 and 3) of the union is on the downstream or lowermost side.

As shown in FIG. 2, the verge member 1 is attached to a wooden roof batten 36 by means of a moulded plastics clip 37. The clip is nailed to the batten 37 at 38 but is clipped over wall portions 15 and 16 of channels 9 and 10 in such a way as to permit movement of the verge member relative to the clip to allow for thermal expansion.

Figure 4:
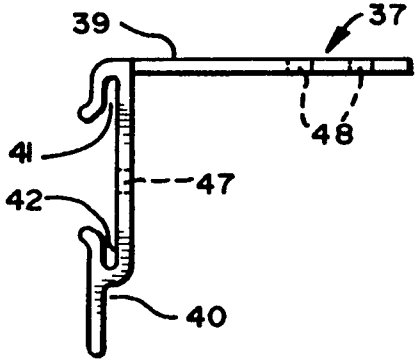
FIG. 4 is a side view of the retaining clip.

As shown more clearly in FIG. 4, the clip has an upper first portion 39 and a perpendicularly disposed second portion 40 formed with two recess portions 41 and 42 which respectively receive the wall portions 15 and 16.

As can be seen in FIG. 2, the free end of upper part 39 of the clip 37 is formed with two lateral protrusions 43. The purpose of these is to allow the clip 37 to perform another function at the bottom of the roof, where the verge arrangement is terminated. Referring now to FIG. 15, therefore, there is shown the arrangement of e.g. FIG. 2 at the bottom of the roof. The verge member 1 with channel 9 projects over a gutter 44 so that any water running down the channel 9 will flow into the gutter. A clip 37 is provided in the normal way and will be nailed to the lowermost roof batten (not shown).

The channel 10 is cut away (e.g. using a backsaw to modify the standard verge member 1) up to the lever of clip 37. A standard clip 37' is then pushed up the lower part of the verge member 1, with its upper part 39' passing up the space 45 between channels 9 and 10. The protrusions 43' on this clip then snaps behind the part 40 of clip 37. Thus, clip 37' is firmly held in place and in this position blocks the space 46 below the channels 9 and 10 so as to prevent the ingress of birds, vermin etc. into the roof below the slates.

Figure 5:
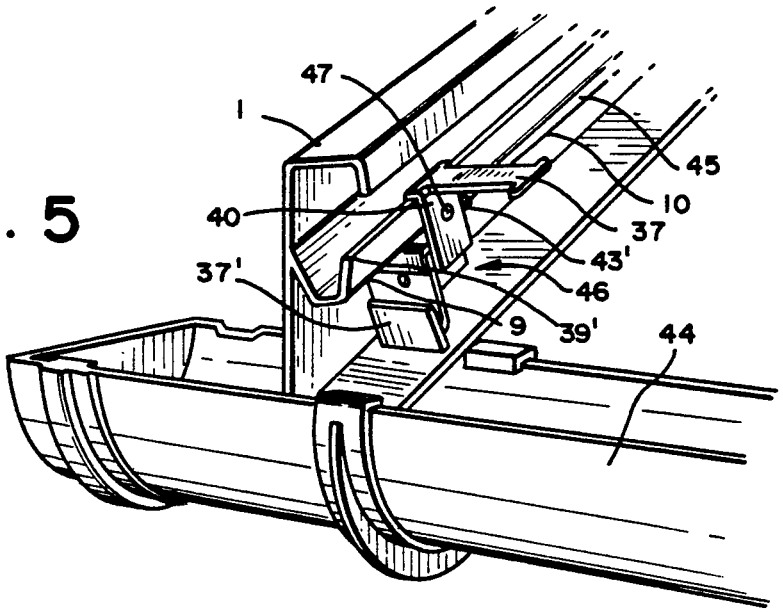
FIG. 5 is a view showing the construction at the bottom of a roof verge, adjacent an eaves gutter, with the slates and battens omitted for reasons of clarity.

As can be seen in FIGS. 4 and 5 the part 40 of clip 37 is also provided with an aperture 47. The purpose of this is to permit the clip 37 to be securely fastened to verge member 1 by means of a fastener such as a self tapping screw which will pass through the aperture and into the space 45 between channels 9 and 10. This may be desirable at certain points, such as at the top of the roof, to fix the system securely to the roof. At other points, of course, movement is permitted to allow for thermal expansion.

There can also be seen apertures 48 in the top part of clip 37, through which pass the nails for securing the clip to a roof batten.

It will be appreciated that many variations are possible both to the specific embodiment described and to the broad features referred to earlier. Many features are new both separately and in combination, such as the verge member, union, clip, or parts thereof, and the various way in which the components are used together on a roof whether generally or at specific places. All of these new features are inventive and protection may be sought hereunder for all of them. Furthermore, it is not intended that any terms used herein, whether by way of technical description or by way of broad statements of essential or desirable features, should exclude structures or features which at least to a substantial extent have the same or similar effects.

I claim:

1. An elongate roof verge member for covering edges of roof covering members at a verge of a pitched roof, comprising an upwardly directed outer portion having longitudinal side edges for concealing the edges of the roof covering members, inwardly directed flanges adjacent said longitudinal side edges of the outer portion, and a first water conducting member on an inner surface of the outer portion, the first water conducting member facing one of the flanges and defining therewith a first gap adapted to receive the edge of a roof covering member having a first thickness, said roof verge member also comprising a second water conducting member facing the other of the flanges and defining therewith an alternative gap adapted to receive the edge of a roof covering member having a second thickness different from the first thickness when the roof verge member is inverted, the alternative gap being of a different size than the first gap, said first and second water conducting members being adapted to conduct water longitudinally along said outer portion.

2. A verge member as claimed in claim 1, wherein the water conducting members are in the form of channels.

3. A verge member as claimed in claim 1, wherein the water conducting members each has a first side wall extending from the outer portion; a bottom wall; and a second side wall.

4. A verge member as claimed in claim 3, wherein the first side walls of the water conducting members are inclined towards each other in a direction away from the outer portion.

5. A verge member as claimed in claim 1, wherein the water conducting members are disposed symmetrically between the flanges, and one of the flanges has a terminal portion directed towards its respective water conducting member so that the first gap between the flange and the water conducting member is smaller than the alternative gap between the other flange and water conducting member.

6. A verge member as claimed in claim 1, further comprising a longitudinally extending space provided between the water conducting members.

7. A roof verge system for covering edges of roof covering members at a verge of a pitched roof, comprising a plurality of elongate roof verge members, each verge member comprising an upwardly directed outer portion having longitudinal side edges for concealing the edges of the roof covering members, inwardly directed flanges adjacent said longitudinal side edges of the outer portion, and a first water conducting member on an inner surface of the outer portion, the first water conducting member facing one of the flanges and defining therewith a first gap adapted to receive the edge of a roof covering member having a first thickness, said roof verge member also comprising a second water conducting member facing the other of the flanges and defining therewith an alternative gap adapted to receive the edge of a roof covering member having a second thickness different from the first thickness when the roof verge member is inverted, the alternative gap being of a different size than the first gap, said first and second water conducting members being adapted to conduct water longitudinally along said outer portion and said verge member further comprising a longitudinally extending space provided between the water conducting members, wherein said verge members are joined end to end by unions, each union having an outer portion overlying outer portions of verge members which are joined, a first inwardly directed flange overlying first flanges of the verge members, a second inwardly directly flange overlying second flanges of the verge members, a pair of upstream channel-shaped parts which are received in the space between and overlie the water conducting members of one verge member, a pair of downstream channel-shaped parts which extend into the water conducting members of another verge member, the downstream parts being separated by a space which receives the water conducting members, and walls which join each downstream part to its respective upstream part.

8. A roof verge system as claimed in claim 7, wherein the water conducting members are disposed symmetrically between the flanges, and one of the flanges has a terminal portion directed towards its respective water conducting member so that the first gap between the flange and the water conducting member is smaller than the alternative gap between the other flange and water conducting member, wherein the upstream parts and downstream parts of each union are positioned in a mirror image fashion centrally between the first inwardly directed flange and the second inwardly directed flange of the union.

9. A roof verge system as claimed in claim 7, wherein clips are arranged to be securable to the roof and engageable with the verge members in such a member as to permit longitudinal sliding movement to allow for thermal effects.

10. A roof verge system as claimed in claim 9, wherein the clips have portions arranged to slidably receive walls of the pair of water conducting members of each verge member.

11. A roof verge system as claimed in claim 10, wherein the clips are arranged to be fastened securely to the verge members at selected positions by fastening means passing through apertures in the clips and into the spaces between the water conducting members.

12. A roof verge system as claimed in claim 9, wherein the clips are also arranged to be used to block parts of the verge members at the lower end of a roof.

13. A roof verge system as claimed in claim 12, wherein each clip has a first portion arranged to be secured to part of the roof and a second portion arranged to be engaged with the water conducting members, and wherein when a clip is to be used to block part of a verge member, the first portion can be inserted in a longitudinal direction into the space between the water conducting members, the second portion then blocking the lower part of the verge member.

14. A roof verge system as claimed in claim 13, wherein each clip has lateral protrusions on the first portion arranged, so that when a clip is used to block part of a verge member, one of the protrusions can engage behind the second portion of a like clip which is secured to the roof and engaged with the water conducting members.

15. A union for use in a verge system which includes an elongate roof verge member for covering edges of roof covering members at a verge of a pitched roof, the roof verge member comprising an upwardly directed outer portion having longitudinal side edges for concealing the edges of the roof covering members, inwardly directed flanges adjacent said longitudinal side edges of the outer portion, and a first water conducting member on an inner surface of the outer portion, the first water conducting member facing one of the flanges and defining therewith a first gap for receiving the edge of a roof covering member, said roof verge member also comprising a second water conducting member facing the other of the flanges and defining therewith an alternative gap for receiving the edge of a roof covering member when the roof verge member is inverted, and wherein the water conducting members are disposed symmetrically between the flanges, one of the flanges having a terminal portion directed towards its respective water conducting member so that the first gap between the flange and the water conducting member is smaller than the alternative gap between the other flange and water conducting member, said union comprising an outer portion for overlying the outer portion of verge members to be joined, a first inwardly directed flange for overlying first flanges of the verge members, a second inwardly directly flange overlying second flanges of the verge members, a pair of upstream channel-shaped parts which are to be received in the space between and overlie the water conducting members of one verge member, a pair of downstream channel-shaped parts which extend into the water conducting members of another verge member, the downstream parts being separated by a space for receiving the the water conducting members, and walls which join each downstream part to its respective upstream part, the upstream parts and downstream parts of the union being positioned in a mirror image fashion centrally between the first inwardly directed flange and the second inwardly directed flange.

16. An apparatus for forming a roof verge system for covering edges of roof covering members at a verge of a pitched roof, comprising:

(a) a plurality of identical elongate verge members for covering the edges of roof covering members at the verge of a pitched roof, each verge member comprising an upwardly directed outer portion having longitudinal side edges for concealing the edges of the roof covering members, inwardly directed flanged adjacent said longitudinal side edges of the outer portion, and a first water conducting member on an inner surface of the outer portion, the first water conducting member facing one of the flanges and defining therewith a first gap for receiving the edge of a roof covering member, each roof verge member also comprising a second water conducting member facing the outer of the flanges and defining therewith an alternative gap for receiving the edge of a roof covering member when the roof verge member is inverted, wherein the water conducting members are disposed symmetrically between the flanges and one of the flanges has a terminal portion directed towards its respective water conducting member so that the first gap between the flange and the water conducting member is smaller than the alternative gap between the other flange and water conducting member, and wherein a longitudinally extending space is provided between the water conducting members; and (b) a plurality of unions, each union comprising an outer portion for overlying the outer portion of verge members to be joined, a first inwardly directed flange for overlying first flanges of the verge members, a second inwardly directly flange for overlying second flanges of the verge members, a pair of upstream channel-shaped parts which are to be received in the space between and overlie the water conducting members of one verge member, a pair of downstream channel-shaped parts which are to extend into the water conducting members of another verge member, the downstream parts being separated by a space for receiving the water conducting members, and walls which join each downstream part to its respective upstream part wherein the upstream parts and the downstream parts of the union are positioned in a mirror image fashion centrally between the first inwardly directed flange and the second inwardly directed flange, and wherein the verge members are arranged to be joined together by the unions and are arranged to be used either way up so that either the first gaps or the alternative gaps of the verge members may receive the edges of roof covering members so that the same apparatus may can be used with roof covering members of different thickness.

17. An apparatus as claimed in claim 16, wherein clips are arranged to be securable to the roof and engageable with the verge members in such a manner as to permit longitudinal sliding movement to allow for thermal effects.

18. A roof verge system as claimed in claim 17, wherein the clips have portions arranged to slidably receive walls of the pair of water conducting members of each verge member.

19. A roof verge system as claimed in claim 18, wherein the clips are arranged to be fastened securely to the verge members at selected positions by fastening means passing through apertures in the clips and into the space between the water members.

20. A roof verge system as claimed in claim 17, wherein the clips are also arranged to be used to block parts of the verge members at the lower end of a roof.

21. A roof verge system as claimed in claim 18, wherein each clip has a first portion arranged to be secured to part of the roof and a second portion to be engaged with the water conducting members, and wherein when a clip is to be used to block part of a verge member, the first portion can be inserted in a longitudinal direction into the space between the water conducting members, the second portion then blocking the lower part of the verge member.

22. A roof verge system as claimed in claim 18, wherein each clip has lateral protrusions on the first portion arranged so that when a clip is used to block part of a verge member, one of the protrusions can engage behind the second portion of a like clip which is secured to the roof and engaged with the water conducting members.

* * * * *